US008561769B2

(12) United States Patent
Andochick

(10) Patent No.: US 8,561,769 B2
(45) Date of Patent: Oct. 22, 2013

(54) STACKABLE, TOWABLE LUGGAGE

(76) Inventor: Scott E. Andochick, Potomac, MD (US)

( * ) Notice: Subject to any disclaimer, the term of this patent is extended or adjusted under 35 U.S.C. 154(b) by 1279 days.

(21) Appl. No.: 12/333,110

(22) Filed: Dec. 11, 2008

(65) Prior Publication Data

US 2010/0147642 A1 Jun. 17, 2010

(51) Int. Cl.
*A45C 5/00* (2006.01)

(52) U.S. Cl.
USPC ..... 190/18 A; 190/18 R; 190/108; 190/115; 280/37; 206/504; 206/509; 206/510; 206/511

(58) Field of Classification Search
USPC ..... 190/18 A, 18 R, 108, 115; 280/37; 206/504, 509, 510, 511
See application file for complete search history.

(56) References Cited

U.S. PATENT DOCUMENTS 2,497,173 A 2/1950 Kossow
3,061,057 A 10/1962 Miller
3,452,846 A 7/1969 Joachim
3,532,355 A 10/1970 Hawkes
3,572,253 A * 3/1971 Roeder ..... 410/156
3,650,216 A * 3/1972 Harwick et al. ..... 104/166
3,861,703 A 1/1975 Gould
3,891,230 A * 6/1975 Mayer ..... 280/43.24
4,081,061 A 3/1978 Tucker
4,118,048 A 10/1978 Spranger et al.
4,122,925 A * 10/1978 Schultheiss ..... 190/108
4,350,194 A 9/1982 Brown
4,621,716 A 11/1986 Rienacker
4,657,135 A 4/1987 Kjose
4,693,345 A 9/1987 Mittelmann
D294,775 S 3/1988 Rechberg
4,738,340 A 4/1988 Crespi
4,792,025 A 12/1988 Thomas
4,813,521 A 3/1989 Goldstone
4,951,818 A 8/1990 Johnson
5,038,842 A 8/1991 Huang
5,048,649 A 9/1991 Carpenter et al.
5,109,961 A * 5/1992 Bergman ..... 190/18 A
5,142,445 A 8/1992 Sorensen et al.
5,178,244 A 1/1993 Liang
5,186,290 A 2/1993 Takayama
5,197,579 A 3/1993 Bieber et al.
5,339,934 A 8/1994 Liang
5,373,104 A 12/1994 Brauer
5,379,870 A 1/1995 Sadow
5,407,039 A 4/1995 Alper et al.
5,447,216 A 9/1995 Freyvogel
5,484,045 A * 1/1996 Kikuchi et al. ..... 192/58.4
5,484,046 A * 1/1996 Alper et al. ..... 190/115
5,632,496 A 5/1997 Nelson
5,713,439 A 2/1998 Zionts et al.
5,890,571 A 4/1999 Sadow
5,927,361 A 7/1999 Sanderson et al.
6,073,737 A 6/2000 Kang (Continued)

*Primary Examiner* — Anthony Stashick
*Assistant Examiner* — Cynthia Collado

(57) ABSTRACT

An interlocking case system includes a base case having a luggage receptacle and an overlying lid that together form a luggage compartment. One or more swivel wheels are located in proximity to one end of the base case and at least one non-swivel wheel is located at the other end. An upper case is configured to interlock with, and be supported by, the base case when the base case is supported by the first and second swivel wheels and the at least one non-swivel wheel. The case system may be towed using a flexible towing strap coupled to the base case.

23 Claims, 7 Drawing Sheets

(56) References Cited

U.S. PATENT DOCUMENTS

| | | | | |
|---|---|---|---|---|
| 6,116,390 | A | 9/2000 | Cohen | |
| 6,164,425 | A | 12/2000 | Latshaw | |
| 6,213,266 | B1 | 4/2001 | Hollingsworth | |
| D453,623 | S | 2/2002 | Meissner | |
| 6,401,890 | B1 | 6/2002 | Tan | |
| 6,520,327 | B1 | 2/2003 | Boardman et al. | |
| 6,585,090 | B2 * | 7/2003 | Harvey | 190/108 |
| 6,634,496 | B2 | 10/2003 | Scoglio | |
| 6,758,334 | B2 | 7/2004 | Uner et al. | |
| 6,976,566 | B1 | 12/2005 | Skriloff | |
| 7,077,252 | B2 | 7/2006 | Sanchez | |
| 7,232,018 | B1 | 6/2007 | Salander | |
| 7,380,685 | B2 | 6/2008 | Simmons et al. | |
| 7,398,868 | B2 | 7/2008 | Morszeck | |
| 7,726,483 | B2 | 6/2010 | Ramanujam et al. | |
| 7,780,002 | B2 | 8/2010 | Manaster et al. | |
| 7,942,282 | B2 | 5/2011 | Hung | |
| 2003/0029750 | A1 | 2/2003 | Boardman et al. | |
| 2003/0123965 | A1 * | 7/2003 | Brackmann et al. | 414/467 |
| 2005/0072642 | A1 | 4/2005 | Sanchez | |
| 2005/0077136 | A1 | 4/2005 | Brannin | |
| 2006/0119060 | A1 * | 6/2006 | Sullivan et al. | 280/79.11 |
| 2007/0012694 | A1 | 1/2007 | Duvigneau | |
| 2007/0068757 | A1 | 3/2007 | Tan | |

* cited by examiner

FIG. 1
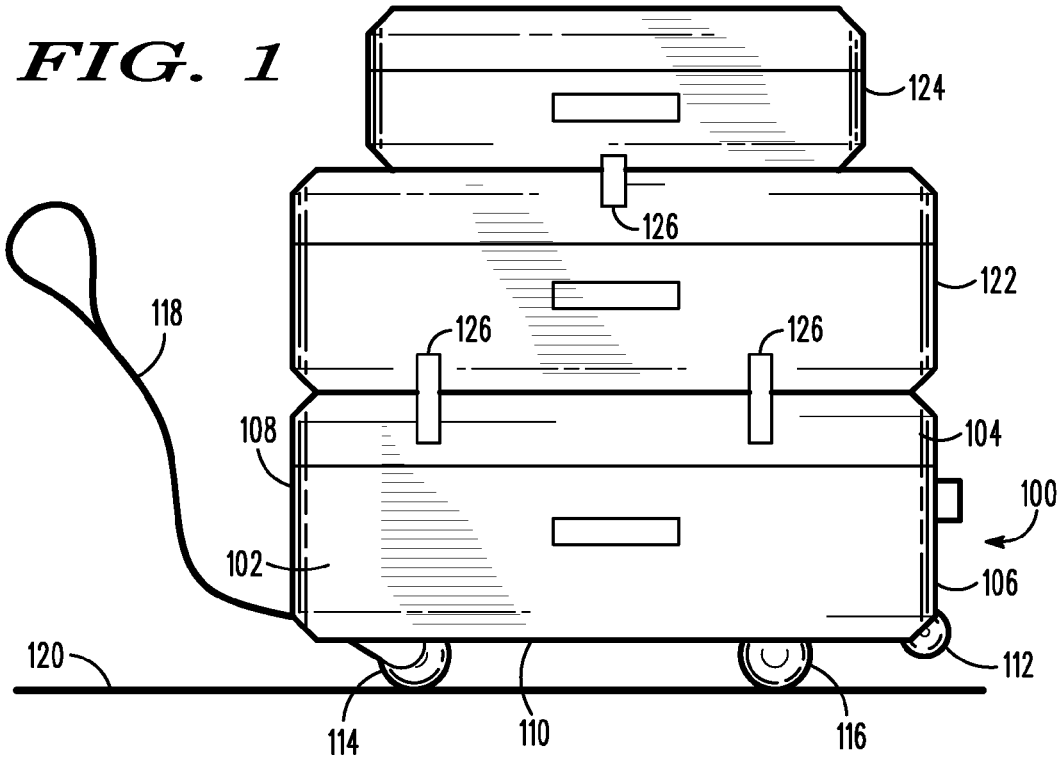
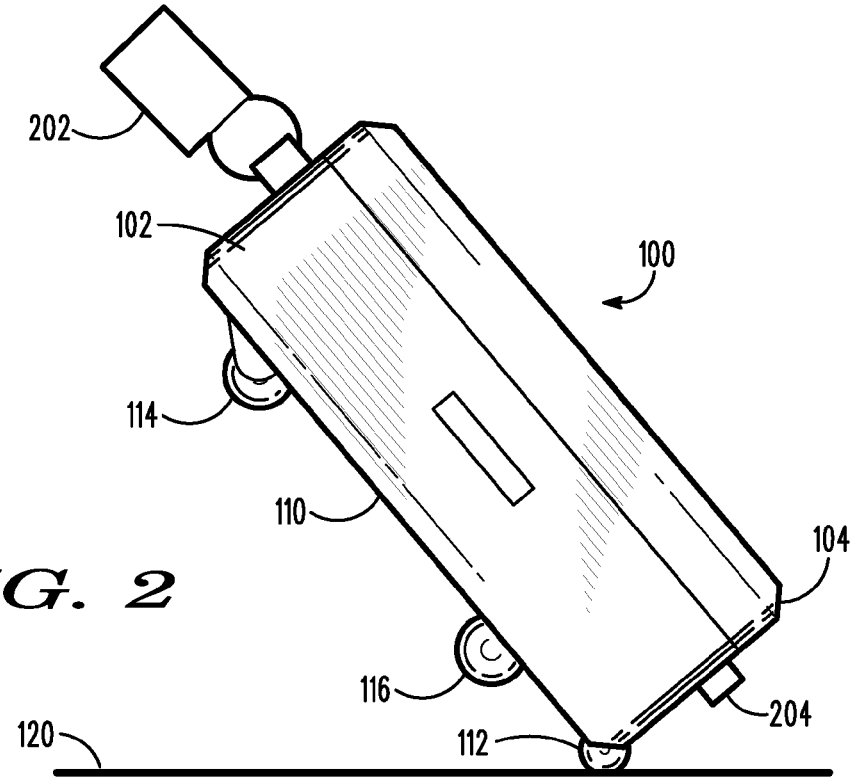
FIG. 2

STACKABLE, TOWABLE LUGGAGE

BACKGROUND

The use of integrated or detachable wheels to facilitate the movement of luggage is well known. Usually, these wheels are located on a side or end of a suitcase, either a single pair of wheels or as multiple wheels.

U.S. Pat. No. 5,407,039 discloses wheeled luggage that is self stabilized and towable via a rigid handle. Here, non-swiveling wheels are placed on an edge of a suitcase and one or more swiveling wheels are placed in the underside of the suitcase. This approach yields a more stable suitcase, which allows a child seat to be fixed to the top of the suitcase.

Stackable storage containers are well known and have been used in conjunction with wheeled carts or dollies.

U.S. Pat. No. 3,532,355 discloses a luggage carrier that can be temporarily attached to a base suitcase of a stack of suitcases to allow the base suitcase to be used as a dolly. However, the stack of suitcases may become unstable when sliding forces are present. This occurs when a corner is turned or when a slope is encountered, for example.

This instability problem is made worse when a stacked item has a cylindrical or spherical shape that tends to roll. Examples include balls for soccer or other sports, cylindrical bags for carrying golf clubs, tubes for carrying art work, and air cylinders for scuba diving.

BRIEF DESCRIPTION OF THE FIGURES

The accompanying figures, in which like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 1 is a side view of an exemplary luggage system in accordance with some embodiments of the invention.

FIG. 2 is a further side view of an exemplary luggage system in accordance with some embodiments of the invention.

Figure 3:
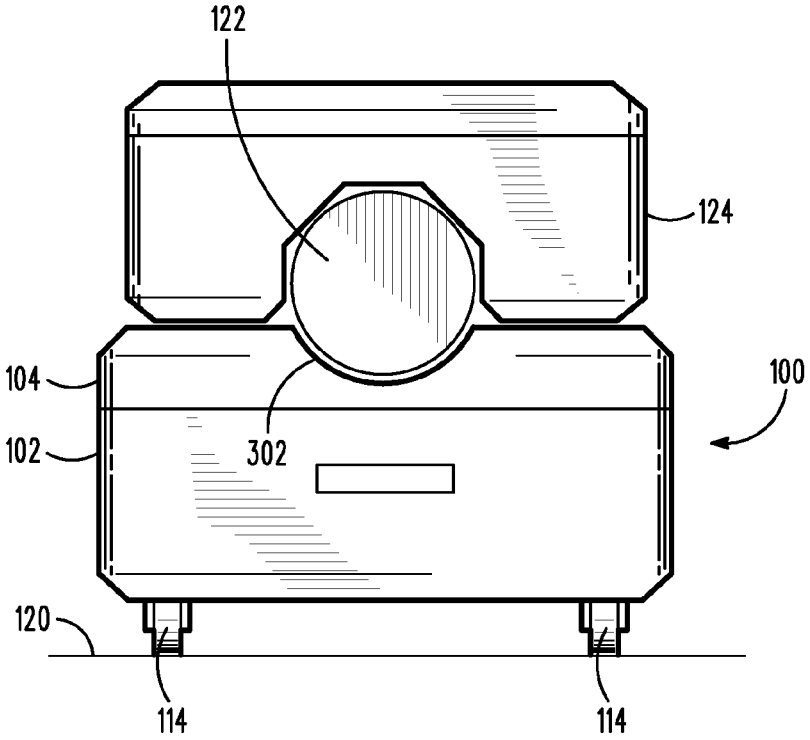
FIG. 3 is a front view of an interlocking luggage system in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an interlocking luggage system. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 is a diagrammatic representation of an interlocking case system consistent with certain embodiments. The system includes a base case 100 that has a luggage receptacle 102 and an overlying lid 104 that together form a luggage compartment. The luggage receptacle 102 has a first end 106, a second end 108, and an underside 110 that is opposite to the lid 104. First and second non-swivel wheels 116 are located at opposite side regions on the underside 110 of the luggage receptacle 102 in proximity to the first end 106 of the luggage receptacle 102. First and second swivel wheels 114 are located at opposite side regions on the underside 110 of the luggage receptacle in proximity to the second end 108 of the luggage receptacle 102. Third and fourth non-swivel wheels 112 are located at opposite side regions on the first end 106 of the luggage receptacle. A flexible towing strap 118 is coupled to the base case 100 and may be used to tow the base case when the wheels 114 and 116 are in contact with the ground 120.

The luggage system also includes a first upper case 122 that is configured to interlock with, and be supported by, the base case 100 when the base case is supported by the first and second swivel wheels 114 and the first and second non-swivel wheels 116. The first upper case may be the same length and width as the base case, or it may have a different length or width.

Optionally, the luggage system may include one or more second upper cases 124 that are configured to interlock with, and be supported by, the first upper case 122 and/or the base case 100. The second upper case may be the same length and width as the first upper case, or it may have a different length or width.

In the first mode of operation depicted in FIG. 1, the third and fourth non-swivel wheels 112 are raised from the ground 120 when the first and second non-swivel wheels 116 and the first and second swivel wheels 114 are in contact with the ground. If desired, the non-swivel wheel 116 may be positioned more towards the center of gravity of the base case 100 in order to accommodate heavier loading. In such an example, the base case 100 may slope upward towards the front wheels 114 at a slight angle, such as at 5 degrees.

In one embodiment a latching mechanism 126 is used to removably couple the base case 100 to the first upper case 122, and to couple the first upper case 112 to any other cases such as 124. Many suitable latching mechanisms will be apparent to those of ordinary skill in the art. These include clasps, hook and loop materials, snap connectors, straps, elastic cords and many others. The latching mechanisms may be found on one or multiple sides; straps, for instance, may be on the circumference of the base case if desired.

Any of the base case and the upper cases may be soft-sided cases or rigid cases or any combination thereof.

Referring now to FIG. 2, the third and fourth non-swivel wheels 112 allow the base case 100 to be used in a second mode of operation in which a user 202 pulls or pushes the case such that the weight of the case is partially borne by the third and fourth non-swivel wheels 112. The base case may be stood in a vertical orientation with the first end 106 facing downwards. In this orientation the case is supported by the third and fourth non-swivel wheels 112 and one or more support posts 204.

When used in the first mode of operation, an interlocking mechanism is used to prevent the upper cases 122 and any additional cases 124 from sliding. This allows the luggage system to be turned more rapidly and allows it to be used on sloping terrain, such as ramps.

In one embodiment, the interlocking mechanism utilizes a recess in the top of the base case that at least partially accommodates the first upper case and resists a horizontal motion of the first upper case. An exemplary embodiment is shown in FIG. 3.

In FIG. 3, the lid 104 of the base case 100 includes a recess 302 to support the upper case 122. The upper case may be a substantially cylindrical golf bag, for example, or other elongated bag for carrying recreational equipment (such as skis, snow boards, skate boards, musical instruments, fishing equipment, diving equipment, rifles, etc.).

A second upper case 124 may be supported by the first upper case 122, or, as shown in FIG. 3, may be supported by the base suit case. In the latter case, the stack of luggage is interlocked.

Figure 4:
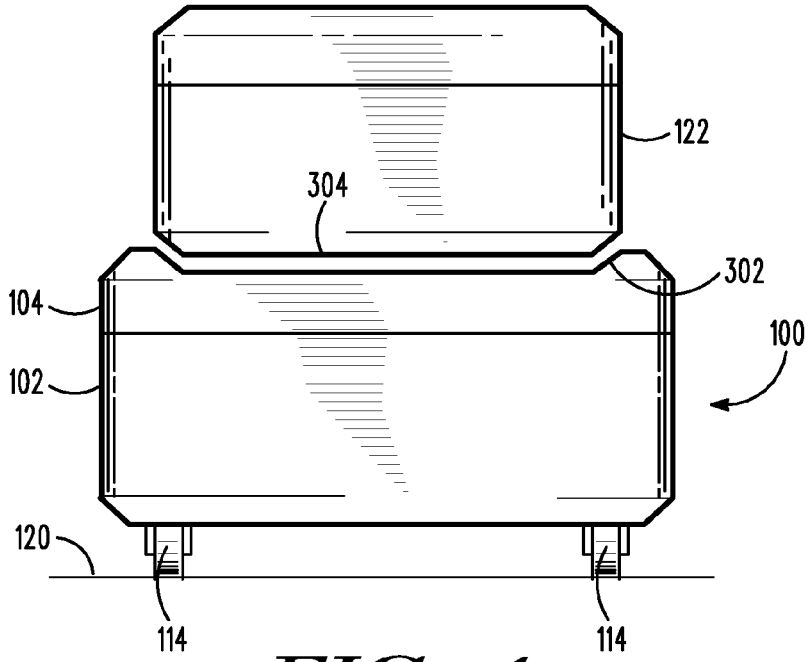
FIGS. 4 and 5 are lateral section views of further interlocking luggage systems in accordance with some embodiments of the invention.

Upper cases of other shapes may be accommodated. FIG. 4 shows a lateral cross section through an exemplary luggage system. In this example, the lower portion 304 of upper case 122 is accommodated by a corresponding recess 302 in the lid of the base case 100. This prevents sliding of the upper case relative to the lower case and stabilizes the stack of luggage.

Figure 5:
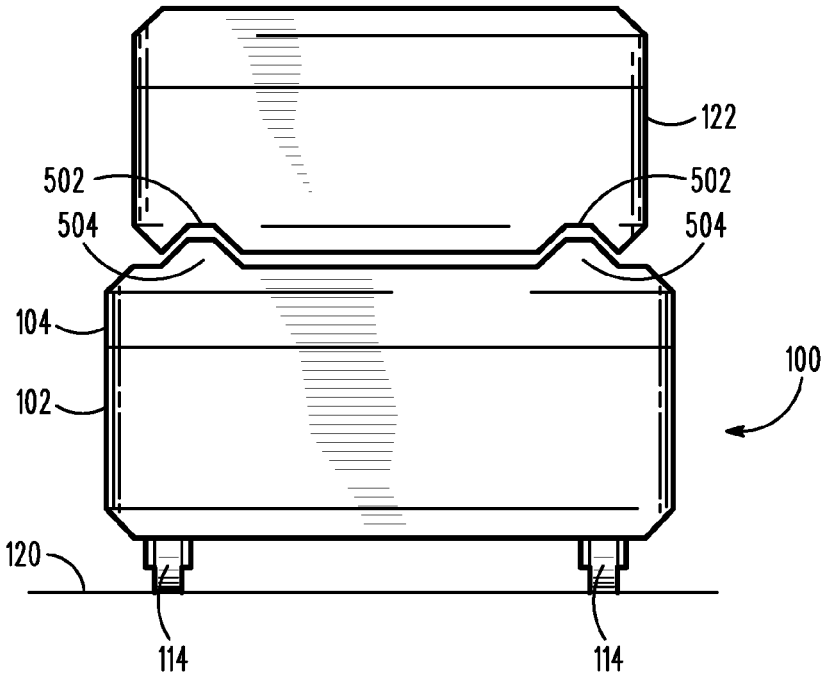

FIG. 5 shows an alternative interlocking mechanism in which recesses 502 in the underside of the upper case 122 interlock with protrusions 504 on the top of the base case 100. One or more protrusion/recess pairs may be used. The protrusion/recess pairs may be elongated, running almost the full length of the cases, or the protrusions may be mound-like. The shape, size, number and location of the protrusion/recess pairs may be varied without departing from the present invention.

Figure 6:
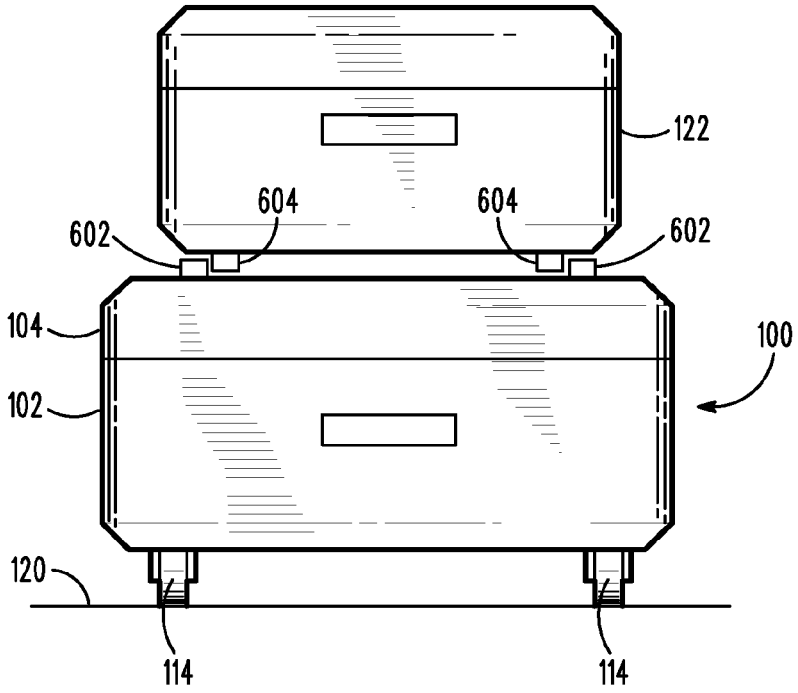
FIGS. 6 and 7 are front views of still further interlocking luggage systems in accordance with some embodiments of the invention.

FIG. 6 shows a further interlocking mechanism in which rails 602 on the top of the base case 100 interlock with corresponding rails 604 on the underside of the upper case 122. The rails 602 and 604 prevent, or at least limit, lateral motion of the upper case 122 relative to the base case 100. The rails may be made of a tough material, such as plastic or metal for example, to resists damage to the cases 100 and 122.

Figure 7:
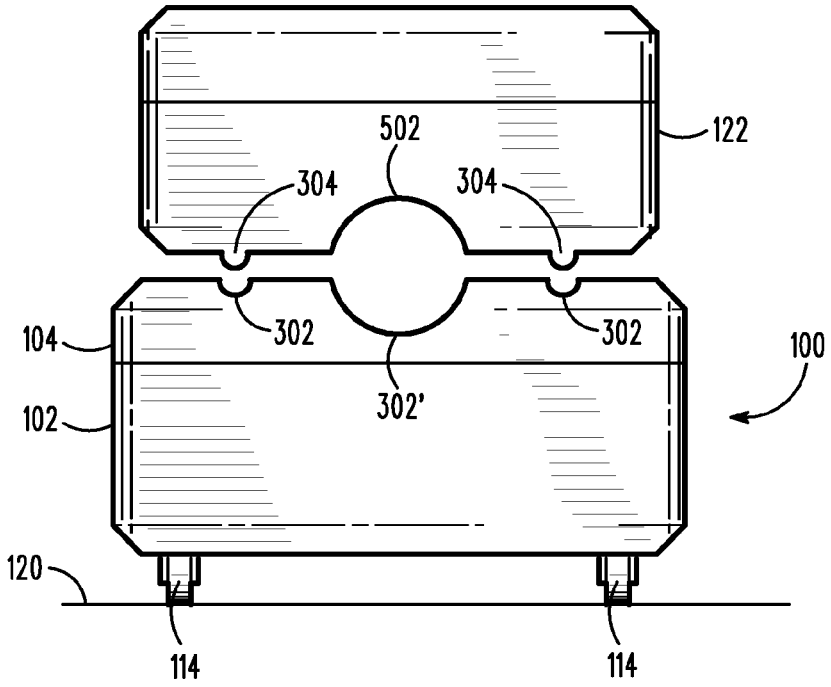

FIG. 7 is lateral section view of a further embodiment of an interlocking luggage system. In FIG. 7, the lid 104 of the base case 100 has linear recesses 302 that mate with corresponding linear protrusions or tracks 304 on the underside of an upper case 122. This provides an interlocking mechanism that prevents lateral motion of the upper case 122 relative to the base case 100. In this example, the lid 104 of the base case 100 also contains a larger recess 302' that aligns with a corresponding recess 502 in the upper case 122. These two recesses form a cavity which may be used to accommodate a further upper case, such as a bag for carrying golf clubs.

Figure 8:
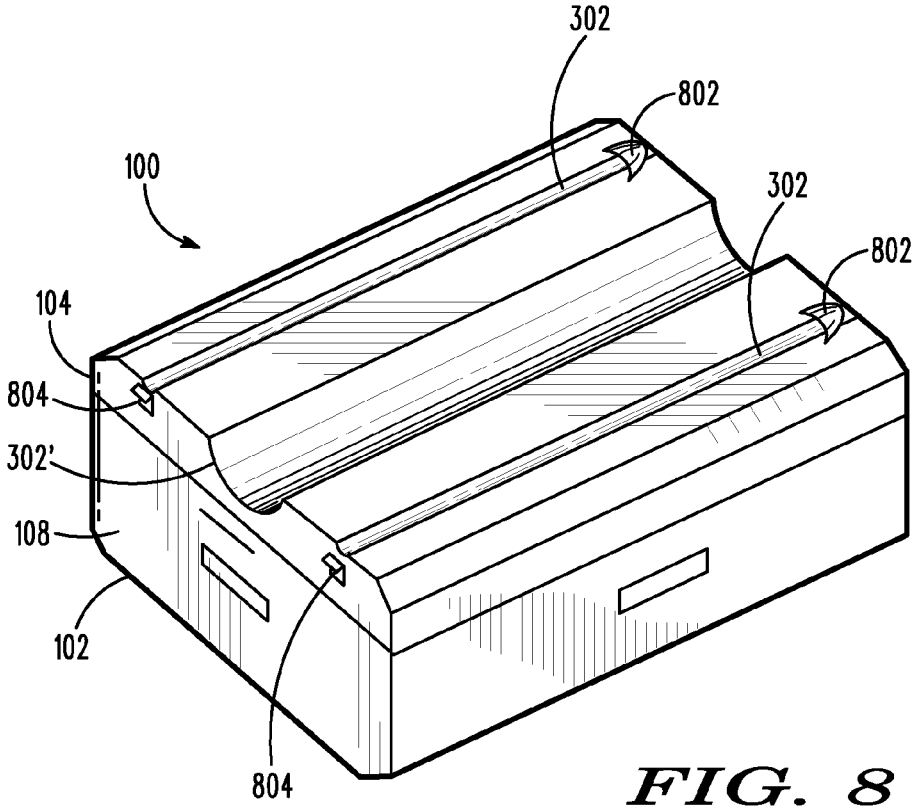
FIG. 8 is a view of a base suitcase in accordance with some embodiments of the invention.

FIG. 8 is a view of a base case 100 in accordance with some embodiments. In this embodiment, recesses in the form of receiving ends 802 are located at one end of each linear recess 302 in the lid 104 of the base case 100. The receiving ends 802 receive protruding ends of the tracks (304 in FIG. 7) of an upper case and prevent the upper case from sliding backwards relative to the base case. Catches 804 are located at the other end 108 of the base case 100. The catches 804 are shown in more details in FIG. 9, which is a diagram of a latch in accordance with an embodiment. The latch comprises a catch 804 attached to the lid 102 of the base case and a hook 904 attached to the upper case 122. The hooks are attached via flexible elements 906, which may be metal springs or rubber-like material, for example, or an elastic strap. The flexible elements are in tension when the hook 904 is engaged with the catch 804. The hook may be engaged by lowering the upper case 122 onto the base case or by pulling on finger loop 908. The hook may be disengaged by pulling on finger loop 908. In a further embodiment, the hook comprises a loop of elastic cord. Other types of latching mechanism will be apparent to those of ordinary skill in the art. Latches may be used at other locations on the base case.

Figure 9:
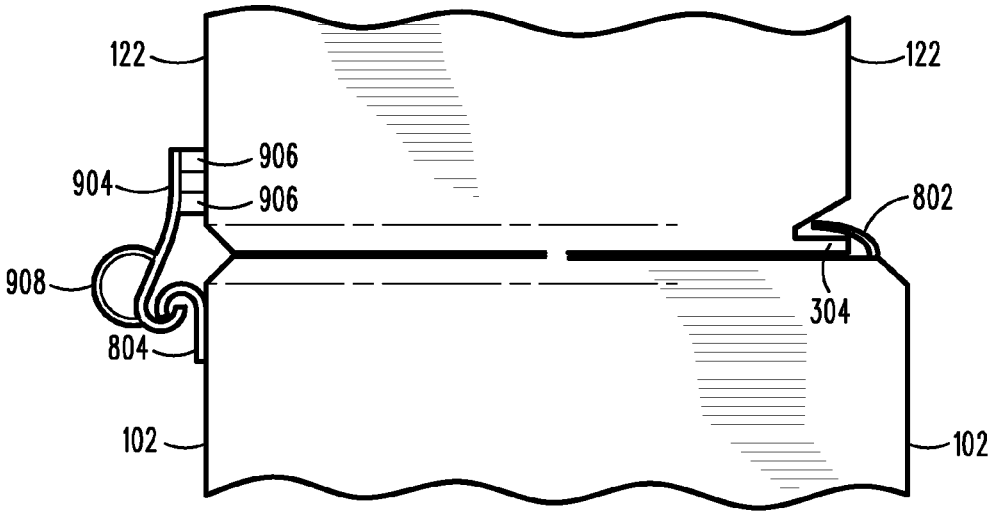
FIG. 9 is a diagram of a latch in accordance with some embodiments of the invention.

Also shown in FIG. 9 is a receiving end 802 that is configured to receive a protruding end of the track 304.

Figure 10:
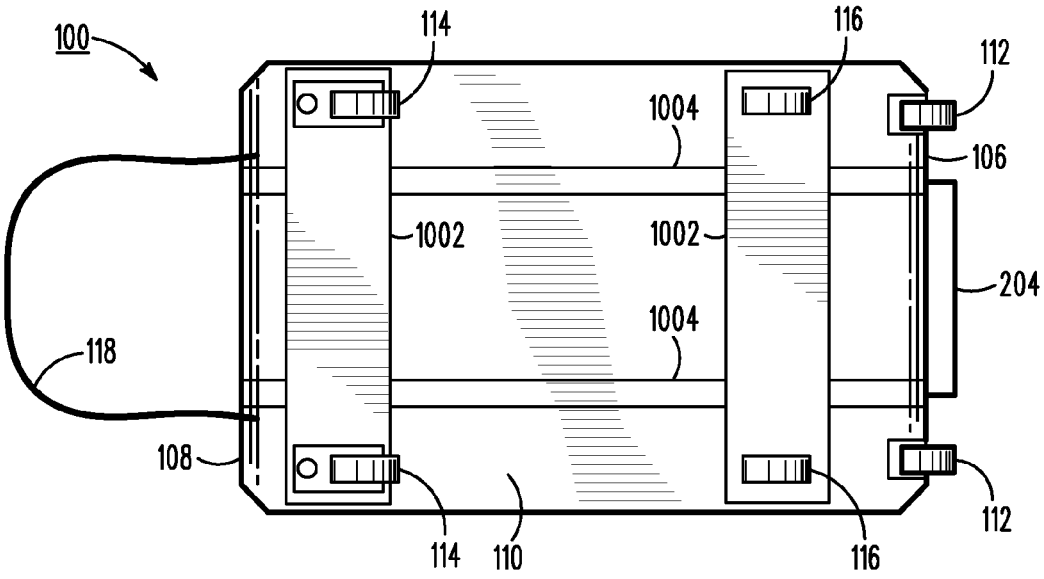
FIG. 10 is a view of the underside of an interlocking luggage system in accordance with some embodiments of the invention.

FIG. 10 is a view of the underside of a base case 100 of an interlocking luggage system in accordance with some embodiments. The base case 100 has swivel wheels 114 located on the underside in proximity to end 108 of the base case and non-swivel wheels 116 located on the underside in proximity to end 106 of the base case. The wheels are spaced laterally to provide a stable base of support for the base case 100. The wheels may be attached to cross supports 1002 to distribute the weight of the base case and any upper cases. Longitudinal supports 1004 may also be used to further distribute the load. Additional non-swivel wheels 112 are positioned end 106 of the base case, together with support post 204. The non-swivel wheels 112 and support post 204 support the base case when it is in a vertical orientation. A flexible towing strap 118 may be used to tow the base case. Alternatively, a rigid handle may be used that allows the base case to be pulled or pushed.

Figure 11:
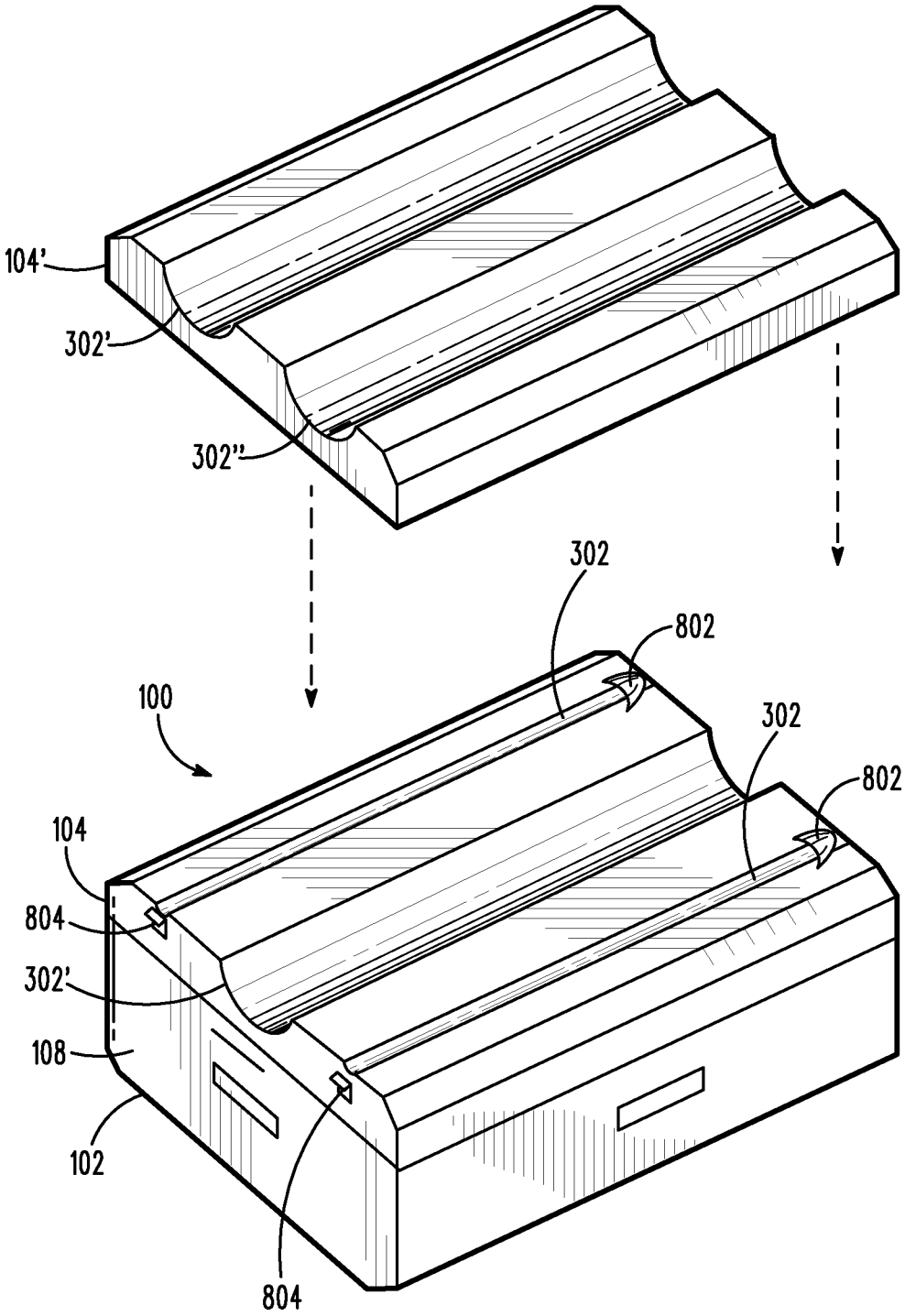
FIG. 11 is a view of an interlocking luggage system with interchangeable lids in accordance with some embodiments of the invention.

FIG. 11 is a view of an interlocking luggage system with interchangeable lids in accordance with some embodiments of the invention. In one embodiment, the lid 104 of base case 100 may be detached from the luggage receptacle 102. For example, the lid 104 could be attached using a zip fastener that encompasses the lower perimeter of the top 104. An alternative lid 104' may then be attached to the base suitcase. In the example shown in FIG. 11, the lid 104 is shaped to accommodate a single cylindrical case, such as a golf bag, while the lid 104' is shaped to accommodate two cylindrical cases. An interlocking luggage system may include multiple interchangeable lids, each designed to accommodate different sized upper cases or different numbers of upper cases.

Figure 12:
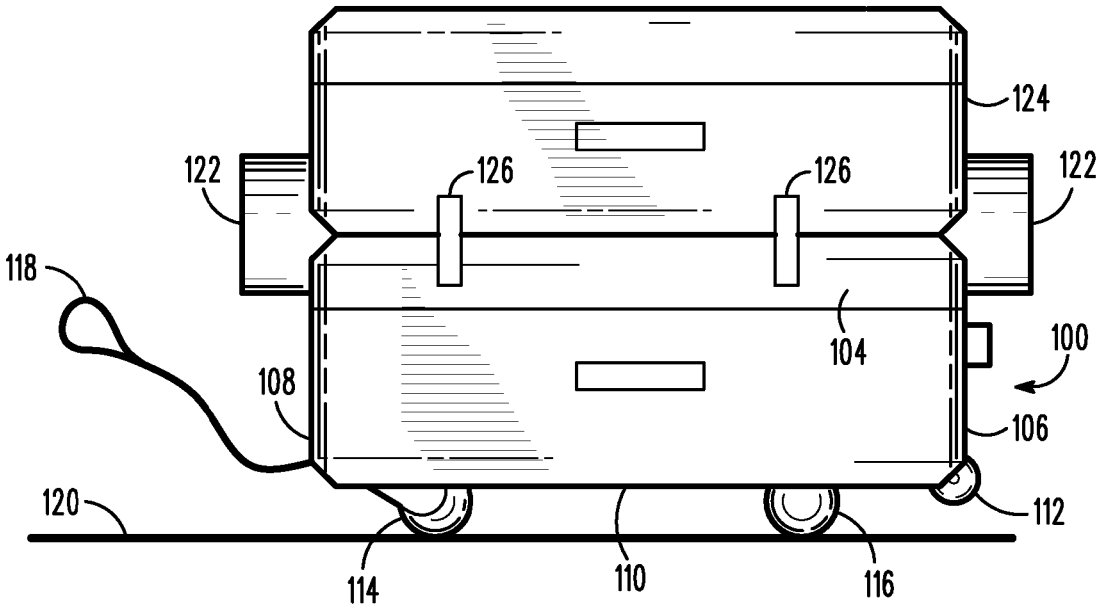
FIG. 12 is a side view of an interlocking luggage system in accordance with some embodiments of the invention.

FIG. 12 is a side view of an interlocking luggage system in accordance with some embodiments of the invention. FIG. 12 shows an elongated upper case 122 that is supported by the base case 100. The elongated upper case 122 is accommodated in a recess in the lid 104 of the base case 100 and is further accommodated in a recess in the bottom of the upper case 124. In this manner the cases 100 and 124 are interlocked together by the case 122. Additional interlocking mechanisms 126 may also be used.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An interlocking case system, comprising:

a base case comprising:

a luggage receptacle and a first overlying lid that together form a luggage compartment, the luggage receptacle having first and second ends and an underside that is opposite to the lid;

first and second non-swivel wheels located at opposite side regions on the underside of the luggage receptacle in proximity the first end of the luggage receptacle;

a first swivel wheel located on the underside of the luggage receptacle in proximity the second end of the luggage receptacle;

a flexible towing strap coupled to the base case; and an interlocking mechanism of the first overlying lid, where the base case is configured to support and interlock with a first upper case when the first upper case engages the interlocking mechanism of the first overlying lid of the base case and when the base case is supported by the first swivel wheel and the first and second non-swivel wheels, and where the first overlying lid of the base case is recessed to at least partially accommodate the first upper case and to resist a horizontal motion of the first upper case;

the interlocking case system further comprising a second upper case configured such that an underside of the second upper case is in at least partial direct contact with the first overlying lid of the base case such that the second upper case is not wholly supported by the first upper case when the first upper case is positioned between the base case and the second upper case, wherein the underside of the second upper case is recessed to accommodate the first upper case.

2. An interlocking case system in accordance with claim 1, wherein the top of the base case is recessed to accommodate a protrusion on a lower surface of the first upper case.

3. An interlocking case system in accordance with claim 1, wherein the bottom of the first upper case is recessed to accommodate a protrusion on an upper surface of the base case.

4. An interlocking case system in accordance with claim 1, further comprising a latching mechanism configured to removably couple the base case and the first upper case.

5. An interlocking case system in accordance with claim 4, wherein the latching mechanism is selected from the group of mechanisms consisting of a clasp, an elastic cord, a hook-and-loop strap, hook-and-loop patches, a snap connector, a sprung hook and catch.

6. An interlocking case system in accordance with claim 1, wherein the first upper case comprises a substantially rigid case.

7. An interlocking case system in accordance with claim 1, wherein the overlying lid of the base case contains at least one linear recess configured to accommodate a track on the underside of the first upper case.

8. An interlocking case system in accordance with claim 7, further comprising a receiving end attached to the overlying lid of the base case and configured to accommodate a protruding end of the track on the underside of the first upper case.

9. An interlocking case system in accordance with claim 1, further comprising a second swivel wheel located on the underside of the luggage receptacle in proximity the second end of the luggage receptacle, wherein the first and second swivel wheels are located at opposite side regions of the luggage receptacle.

10. An interlocking case system in accordance with claim 1, further comprising third and fourth non-swivel wheels located at opposite side regions on the first end of the luggage receptacle.

11. An interlocking case system in accordance with claim 10, wherein the third and fourth non-swivel wheels are raised from the ground when the first and second non-swivel wheels and the first and second swivel wheels are in contact with the ground.

12. An interlocking case system, comprising:

a base case comprising:

a luggage receptacle and a first overlying lid that together form a luggage compartment, the luggage receptacle having first and second ends and an underside that is opposite to the lid;

first and second non-swivel wheels located at opposite side regions on the underside of the luggage receptacle in proximity the first end of the luggage receptacle;

a first swivel wheel located on the underside of the luggage receptacle in proximity the second end of the luggage receptacle;

a flexible towing strap coupled to the base case;

an interlocking mechanism of the first overlying lid; and an upper case;

where the base case is configured to support and interlock with the upper case when the upper case engages the interlocking mechanism of the first overlying lid of the base case and when the base case is supported by the first swivel wheel and the first and second non-swivel wheels, and where the first overlying lid of the base case has an elongated recess to at least partially accommodate a golf bag, and where the underside of the upper case is recessed to accommodate the golf bag and the underside of the upper case is configured to be in at least partial direct contact with the first overlying lid of the base case such that the upper case is not wholly supported by the golf bag when the golf bag is positioned between the base case and the upper case.

13. An interlocking case system in accordance with claim 12, wherein the first overlying lid of the base case is substantially rigid.

14. An interlocking case system in accordance with claim 12 wherein the first overlying lid of the base case is adapted to be removably coupled to the luggage receptacle, the interlocking case system further comprising:

at least one second overlying lid adapted to be removably coupled to the luggage receptacle, wherein the first and second overlying lids may be interchanged.

15. An interlocking case system in accordance with claim 14, wherein the first overlying lid is recessed to at least partially accommodate one first upper case and the second overlying lid is recessed to at least partially accommodate more than one first upper case.

16. An interlocking case system in accordance with claim 14, wherein the first overlying lid is recessed to at least partially accommodate a first upper case of a first shape and the second overlying lid is recessed to at least partially accommodate a first upper case of a second shape.

17. An interlocking case system in accordance with claim 14, wherein the first and second overlying lids are adapted to be removably coupled to the luggage receptacle of the base case using one or more zip fasteners.

18. A method for transporting a first case comprising:

placing the first case in a recess in the top of a base case that is supported at a first end by one or more swivel wheels and at a second end by first pair of non-swivel wheels;

placing an upper case on top of the base case such that the first case is at least partially located in a recess in a bottom surface of the upper case to form an interlocking mechanism that prevents lateral motion of the upper case relative to the base case, such that the bottom surface of the upper case is in at least partial direct contact with an upper surface of the base case and is not wholly supported by the first case; and maneuvering the base case using a flexible towing strap connected to the first end of the base case.

19. An interlocking case system, comprising:

a base case comprising:

a luggage receptacle and an overlying lid that together form a luggage compartment, the luggage receptacle having first and second ends and an underside that is opposite to the lid;

first and second non-swivel wheels located at opposite side regions on the underside of the luggage receptacle in proximity the first end of the luggage receptacle;

a first swivel wheel located on the underside of the luggage receptacle in proximity the second end of the luggage receptacle;

a flexible towing strap coupled to the base case; and an interlocking mechanism of the first overlying lid; and a first upper case;

where, when the base case is supported by the first swivel wheel and the first and second non-swivel wheels and a lower surface of the first upper case is in at least partial direct contact with the overlying lid of the base case, a recess in the underside of the first upper case is aligned with a recess in the overlying lid of the base case to form a recess of the interlocking case system, the formed recess suitable to accommodate a second upper case that when inserted into the recess is held in place by first upper case and the base case.

20. An interlocking case system in accordance with claim 19, further comprising at least one second upper case.

21. An interlocking case system, comprising:

a base case comprising:

a luggage receptacle and a first overlying lid that together form a luggage compartment, the luggage receptacle having first and second ends and an underside that is opposite to the lid;

first and second non-swivel wheels located at opposite side regions on the underside of the luggage receptacle in proximity the first end of the luggage receptacle;

a first swivel wheel located on the underside of the luggage receptacle in proximity the second end of the luggage receptacle;

a flexible towing strap coupled to the base case; and an interlocking mechanism of the first overlying lid;

where the base case is configured to support and interlock with a first upper case when the first upper case engages the interlocking mechanism of the first overlying lid of the base case and when the base case is supported by the first swivel wheel and the first and second non-swivel wheels, and where the first overlying lid of the base case is recessed to at least partially accommodate the first upper case and to resist a horizontal motion of the first upper case, the interlocking case system, further comprising:

a second upper case that is recessed to at least partially accommodate the first upper case, the second upper case configured such that a lower surface of the second upper case makes at least partial direct contact with the first overlying lid of the base case, such the second upper case is not wholly supported by the first upper case.

22. An interlocking case system, comprising:

a base case comprising:

a luggage receptacle and an overlying lid that together form a luggage compartment, the luggage receptacle having first and second ends and an underside that is opposite to the lid, and the overlying lid having a recess to at least partially accommodate a first upper case;

first and second wheels located at opposite side regions on the underside of the luggage receptacle in proximity the first end of the luggage receptacle; and a swivel wheel located on the underside of the luggage receptacle in proximity the second end of the luggage receptacle;

a second upper case, the underside of the of the second upper case having a recess to at least partially accommodate the first upper case, where the second upper case is configured such that the underside of the second upper case makes at least partial direct contact with and supported by the overlying lid of the base case when the base case is supported by the swivel wheel and the first and second wheels.

23. The interlocking case system of claim 22, where the recess in the overlying lid of the base and the recess in the underside of the second upper case are sized to accommodate a golf bag and together form a substantially cylindrical cavity.

* * * * *